United States Patent [19]

Carlin

[11] 3,954,581

[45] May 4, 1976

[54] METHOD OF ELECTROLYSIS OF BRINE

[75] Inventor: William W. Carlin, Portland, Tex.

[73] Assignee: PPG Industries, Inc., Pittsburgh, Pa.

[22] Filed: July 22, 1975

[21] Appl. No.: 598,506

[52] U.S. Cl. ..... 204/128; 204/129

[51] Int. Cl.[2] ..... C25B 1/26; C25B 1/02

[58] Field of Search ..... 204/128, 98, 129

[56] References Cited

UNITED STATES PATENTS 3,711,388 1/1973 Gritzner ..... 204/128

FOREIGN PATENTS OR APPLICATIONS 172,727 1965 U.S.S.R. ..... 204/128

*Primary Examiner*—R. L. Andrews

*Attorney, Agent, or Firm*—Richard M. Goldman

[57] ABSTRACT

Disclosed is a method of electrolyzing alkali metal chloride brine in an electrolytic cell having an anolyte chamber containing an anode and a catholyte chamber containing a steel cathode, separated from the anolyte chamber by an asbestos diaphragm. Brine is fed to the anode chamber, a voltage is imposed across the cell, chlorine is evolved at the anode, and hydrogen is evolved at the cathode. According to the disclosed method, the hydrogen overvoltage is reduced by feeding an hydroxy carboxylic acid to the electrolytic cell. Additionally, a phosphorous containing compound and a surfactant may be added to the cell to further reduce the hydrogen overvoltage.

15 Claims, No Drawings

METHOD OF ELECTROLYSIS OF BRINE

BACKGROUND AND SUMMARY

In the process of producing alkali metal hydroxide and chlorine by electrolyzing an alkali metal chloride brine, such as a sodium chloride brine or a potassium chloride brine, in a diaphragm cell, the alkali metal chloride is fed to the anolyte chamber, a voltage is imposed across the cell, and chlorine is recovered from the anolyte chamber while the alkali metal hydroxide, present in a cell liquor with the alkali metal chloride, and hydrogen are recovered from the catholyte chamber. The overall anode reaction is:

$$2Cl^- \rightarrow Cl_2 + 2e^- \quad (1)$$

while the overall cathode reaction is:

$$2H_2O + 2e^- \rightarrow H_2 + 2OH^-. \quad (2)$$

More precisely, the cathode reaction is reported to be $$H_2O + e^- \rightleftharpoons H_{ads} + OH^- \quad (3)$$

by which the monatomic hydrogen is adsorbed onto the surface of the cathode. In basic media, the adsorbed hydrogen is reported to be desorbed according to one of two processes:

$$2H_{ads} \rightleftharpoons H_2 \quad (4)$$

$$H_{ads} + H_2O + e^- \rightleftharpoons H_2 + OH^-. \quad (5)$$

The hydrogen desorption step, i.e., reaction (4) or reaction (5), is believed to be the hydrogen overvoltage determining step. That is, it is the rate controlling step and its activation energy corresponds to the cathodic hydrogen overvoltage. Typically, the electrode potential for the overall reaction (2) is on the order of about 1.1 volts on steel in basic media. Steel, as used herein to characterize cathodes, includes iron and iron alloys useful as chlor-alkali cell cathodes.

However, it has now been found that the hydrogen overvoltage may be reduced, for example, by from about 0.05 volt to about 0.20 volt by adding an hydroxy carboxylic acid, preferably in combination with an organic phosphonate and a surfactant, to the catholyte liquor of the cell.

DETAILED DESCRIPTION OF THE INVENTION

Disclosed is a method of electrolyzing alkali metal chloride brine. The alkali metal may either be sodium or potassium. While most commonly the alkali metal will be sodium and the invention will be described with respect to sodium, sodium hydroxide, and sodium chloride, it is to be understood that the method of this invention is equally useful with potassium chloride brines.

The sodium chloride is fed to the cell as brine. The brine may be saturated brine, for example, sodium chloride brine containing from about 315 to about 325 grams per liter of sodium chloride, an unsaturated brine containing less than about 315 grams per liter of sodium chloride, or a super-saturated brine containing in excess of 325 grams per liter of sodium chloride.

According to the method described herein, the electrolysis is carried out in a diaphragm cell. The diaphragm is most commonly prepared from chrysotile asbestos having fibers in the size range of from about 3T to about 4T, as measured by the Quebec Asbestos Producers' Association standard screen size. The 3T asbestos has a standard screen size of 1/16 (2 mesh), 9/16 (4 mesh), 4/16 (10 mesh), 2/16 (pan), while 4T asbestos has a size distribution of 0/16 (2 mesh), 2/16 (4 mesh), 10/16 (10 mesh), 4/16 (pan), where the numbers within the parentheses refer to the mesh size in meshes per inch.

The asbestos diaphragm may be deposited from cell liquor solution; that is, from a solution containing about 10 to 20 weight percent sodium chloride and most frequently about 15 weight percent sodium chloride, and from about 8 to about 15 weight percent sodium hydroxide and most frequently about 10 percent sodium hydroxide. The liquid composition, e.g., a slurry, may contain from about 0.5 to about 2 weight percent asbestos and most frequently from about 1 to about 1.5 weight percent asbestos.

The diaphragm is typically deposited by inserting the cathode into a cell liquor-asbestos slurry, as described above, and drawing a vacuum within the cathode structure, thereby drawing the slurry through the cathode depositing the asbestos on a surface of the cathode.

Deposition is continued until a suitable thickness of asbestos, for example, from 0.25 to about 0.40 pounds of asbestos per square foot of cathode area is deposited on the cathode. Thereafter, additional treatment may be provided to the diaphragm. For example, the diaphragm may be dehumidified and thereafter heated to a temperature above about 110°C., for example, to a temperature up to about 280°C., i.e., a temperature corresponding to a differential thermal analysis endotherm. Alternatively or additionally, resinous materials may be codeposited with the asbestos or deposited upon the asbestos. These resinous materials may, additionally, be partially melted or completely melted, or fused, thereby adding additional toughness to the diaphragm. Additionally, other methods may be used to increase the physical toughness of the diaphragm without increasing the porosity thereof.

The diaphragm allows the anolyte liquor to percolate through the diaphragm at a high enough rate that the convective or hydraulic flow of hydroxyl ion through the diaphragm to the catholyte liquor exceeds the electrolytic flow of hydroxyl ion from the catholyte liquor through the diaphragm to the anolyte liquor. In this way, the pH of the anolyte liquor is maintained acid and the formation of the chlorate ion is suppressed.

The catholyte liquor typically contains from about 10 to about 20 weight percent sodium chloride and from about 8 to about 15 weight percent sodium hydroxide. The cathode reaction has an electrode potential of about 1.1 volts and, as described above, is:

$$2H_2O + 2e^- \rightarrow H_2 + 2OH^-$$

which is the overall reaction for the adsorption reaction:

$$H_2O + e^- \rightleftharpoons H_{ads} + OH^-$$

and one of two alternative hydrogen desorption reactions:

$$2H_{ads} \rightleftharpoons H_2$$

$$H_{ads} + H_2O + e^- \rightleftharpoons H_2 + OH^-.$$

According to this invention, a hydrogen overvoltage reducing composition is added to the cell. One of the components is an hydroxy carboxylic acid. Another component that may be present in the composition is a phosphorous containing organic compound. There may also be a surfactant present in the composition. While the exact mechanism of the composition and the components thereof has not been completely elucidated, the hydroxy carboxylic acid appears to reduce the bubble size of the hydrogen desorbed from the cathode, while the phosphorous containing compound and the surfactant appear to enhance the effect of the hydroxy carboxylic acid. In this way, the hydrogen overvoltage may be reduced to 0.3 volt or less at a current density of 200 amperes per square foot.

The hydroxy carboxylic acid is a hydroxy carboxylic acid substantially incapable of forming a lactone in basic media, i.e., media having a pH of more than 7 and less than 14, such as cell liquor having the composition described hereinabove. Suitable nonlactone forming hydroxy carboxylic acids include the alpha hydroxy acids, the aryl acids, and the rigid sterically hindered acids.

Most frequently, the hydroxy carboxylic acid is an alpha hydroxy carboxylic acid having a structural formula:

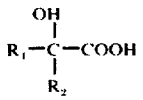

where $R_1$ may be H or an alkyl group $C_nH_{2n+1}$, or an olefinic group $C_nH_{2n}$, and $R_2$ may be H or an alkyl group $C_mH_{2m+1}$, or an olefinic group $C_mH_{2m}$ where $m$ and $n$ are each from 1 to 10 and most frequently from about 1 to about 5, the sum of $m$ and $n$ being such as to allow a solubility of the acid or of salts thereof in water of at least 0.04 weight percent. The hydroxy carboxylic acid may be chosen from the group consisting of alpha hydroxy acetic acid, alpha hydroxy propionic acid, alpha hydroxy butyric acid, alpha hydroxy-alphamethyl-n-butyric acid, 2-hydroxy-n-butyric acid, alpha hydroxy isobutyric acid, and the naturally occurring polyfunctional alpha hydroxy acids such as lactic acid, glyceric acid, citric acid, and the like.

Alternatively, the hydroxy carboxylic acid may be an aryl acid, for example, having the structural formula:

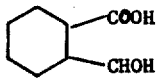

Such acids include mandelic acid, hydroxy benzoic acid, hydroxy cinnamic acid, and hydroxy naphthalenic acid.

The phosphorous containing compound preferably contains a phosphonate group $-P(O)(OM)_2$, where M is hydrogen, sodium, potassium, calcium, magnesium, and ammonium, and the compound is chosen from the group consisting of organic phosphonates and water soluble salts thereof. Water soluble salts of organic phosphonates include the alkali metal salts, such as the sodium salts and potassium salts thereof, the alkaline earth salts, and the ammonium salts thereof. The preferred phosphonates have the formula $R - P(O)(OM)_2$, where M is chosen from the group consisting of hydrogen, sodium, potassium, calcium, magnesium, and ammonium, and R is an organic moiety. For example, the phosphonate may be a phosphonate ester of an oxyethylyted esterified triol or the alkali metal or ammonium salt thereof having the formula:

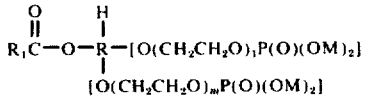

where R is a hydrocarbon with three or more carbon atoms, for example, from 3 to 50 carbon atoms and preferably from 3 to 10 carbon atoms, $R_1$ is a hydrocarbon with from 3 to 20 carbon atoms and preferably from 3 to 10 carbon atoms, $l + m = n$, where n is the total number of $CH_2CH_2O$ units, from 3 to 20 and preferably from 3 to 10, and M is chosen from the group consisting of hydrogen, sodium, potassium, calcium, magnesium, and ammonium.

The phosphorous containing compound may also be a phosphonate ester of a hydroxylamine having the formula:

$$NR_1R_2R_3$$

where $R_1 = CH_2P(O)(OM)_2$ $R_2 = CH_2CH_2OH$ $CH_2P(O)(OM)_2$ $R_3 = (CH_2)_nCH_2P(O)(OM)_2$ $(CH_2)_nCH_2CH_2OH$ $(CH_2)_2P(O)(OM)_2$ $CH_2CH_2OH$ where M is chosen from the group consisting of hydrogen, sodium, potassium, calcium, magnesium, and ammonium, and n is from 1 to 6.

Exemplary phosphorous containing compounds useful in the method of this invention are 1-hydroxyethane-1,1,-phosphonic acid, nitrilotris methylene triphosphonic acid, ethylene bis (dis nitrilo dimethylene) tetraphosphonic acid, and diethylene triamine penta(-methylene phosphonic acid).

When the phosphorous containing compound is added to the cell it should be added at about the same rate as the hydroxy carboxylic acid, i.e., at a feed of from 10 percent to 1,000 percent of the feed rate of the hydroxy carboxylic acid and preferably not more than about 300 percent of the feed rate of the hydroxy carboxylic acid.

Additionally, the liquid composition may also contain a surfactant such as a polymeric surfactant having acid groups. The acid groups may either be pendant acid groups or terminal acid groups. One particularly desirable surfactant having pendant acid groups is polyacrylic acid. Where terminal acid groups are present they may be sulfonic acid groups, phosphonic acid groups, or the like.

While the above description has been with reference to a single liquid composition containing the phosphorous containing acid and the alpha hydroxy carboxylic acid, it should be understood that these two acids may be added to the cell sequentially or through different inlets although it will most frequently be a matter of convenience to add them in combination.

Hydrogen overvoltage reduction appears to be a function of both the concentration of organic materials, i.e., the amount of the phosphorous containing organic compound and of the hydroxy carboxylic acid per unit of catholyte liquor volume, and the cathode surface concentration of organic materials, i.e., the amount of phosphorous containing organic compound and of the hydroxy carboxylic acid per unit of cathode area. Addition may be to the anolyte liquor with an excess of organic materials added to allow for reactions at the anode, reactions with the anolyte liquor, and reactions with the diaphragm, or addition may be directly to the catholyte liquor.

The amount of organic material added to the cell is generally the total amount added per total time since cell start-up, per unit of cathode area and per unit of catholyte volume. However, the addition may also be the total amount added per total time since the first addition of organic material, per unit of cathode area and per unit of catholyte volume. The actual addition may be continuous, discontinuous at regular intervals of several days or weeks, or discontinuous and in response to cathode overvoltage or cell voltage. The rate of addition may conveniently be stated as weight added per square foot of cathode area per day or per unit of anolyte volume per day or per unit of catholyte volume per day. Additions are preferably made during cell operation without shutting the cell down.

The alpha hydroxy carboxylic acid is generally added to the cell while the cell is in operation in sufficient quantity to provide more than about 0.0025 gram equivalents per kilogram of catholyte liquor per addition and preferably about 0.005 gram equivalents of alpha hydroxy carboxylic acid per kilogram of catholyte liquor per addition. The frequency of addition should be high enough to provide a rate of addition, as defined above, of more than about 0.1 gram equivalent of alpha hydroxy carboxylic acid per square meter of cathode area per day and preferably above about 0.2 gram equivalent of alpha hydroxy carboxylic acid per square meter of cathode area per day. Higher feed rates and concentrations may be utilized without deleterious effect.

While the above addition rates and concentrations are based on cathode areas and catholyte volumes, it is to be understood that the addition will most frequently be made into the anolyte chamber of an operating cell during electrolysis, e.g., with the brine feed or in parallel with the brine feed. When addition of the composition is to the anolyte chamber, adjustments in feed rate should be made to allow for reactions with the anolyte liquor, reactions at the anode, and reactions in the diaphragm. The feed rate to the anolyte should be above about 1 gram equivalent per square foot of cathode area per day and preferably about 2 to 5 grams equivalents of alpha hydroxy carboxylic acid per square foot of cathode area per day. The amount of the individual addition to the anolyte liquor should be above about 0.025 gram equivalent of hydroxy carboxylic acid per kilogram of catholyte liquor and preferably above about 0.05 gram equivalent of hydroxy carboxylic acid per kilogram of catholyte liquor. Higher feed rates and concentrations of hydroxy carboxylic acid may be utilized without deleterious effect. The feed rates per unit of area and concentration per volume of electrolyte maintain the hydrogen below about 0.3 volt at 200 amperes per square foot.

The surfactant may also be added to the cell. When the surfactant is added to the cell, it may be added directly to the catholyte chamber or to the anolyte chamber. It may be added in combination with the phosphorous containing acid or with the hydroxy carboxylic acid or with both of them or separately therefrom. Typically, when the surfactant is added, it should be in an amount sufficient to augment the effects of the acids and about equal in weight to the acids.

The organic materials may be added as a single composition or stream to either the anolyte chamber or the catholyte chamber, or as separate streams of the phosphonate, the hydroxy carboxylic acid, and surfactant. According to a preferred exemplification, the phosphonate and the alpha hydroxy carboxylic acid may first be admixed with sodium hydroxide or potassium hydroxide so as to avoid the formation of solids upon addition to the anolyte liquor. According to this exemplification, an aqueous solution of the organics is prepared by admixing an aqueous solution of the phosphorous containing acid and an aqueous solution of the hydroxy carboxylic acid. Thereafter, a 25 to 50 percent aqueous solution of sodium hydroxide and preferably a 30–35 weight percent solution of aqueous sodium hydroxide is added to the organics with evolution of heat.

This material may then be added to the cell. It may be added to the anolyte liquor or directly to the catholyte liquor. Addition may be continuous, discontinuous, for example, at intervals of time, or at intervals determined by the cell voltage, for example, when the cell voltage increases or when the cathode overvoltage begins to increase. The composition may be added with the brine feed or through a separate line.

The following example is illustrative.

Example

A liquid composition of hydroxy acetic acid, 1-hydroxy ethane-1,1-diphosphonic acid, and polyacrylic acid was added at intervals to the anolyte chamber of a pilot plant diaphragm cell. Reductions in both diaphragm voltage drop and cathode overvoltage were observed.

The pilot plant diaphragm cell had a coated titanium anode and a steel cathode.

An asbestos diaphragm was deposited on the steel cathode by inserting the cathode unit in an aqueous slurry containing approximately 10 weight percent sodium hydroxide, approximately 15 weight percent sodium chloride, and approximately 1.5 weight percent grades 3T and 4T chrysotile asbestos fibers. A vacuum was drawn and an asbestos diaphragm weighing 0.37 pounds per square foot was deposited on the cathode. Thereafter the cathode and diaphragm were heated to 180°C. to dry the diaphragm. The cell was then assembled and electrolysis commenced with saturated brine feed and a current density of 190 amperes per square foot.

The liquid composition to be added to the cell was prepared from a 60 percent aqueous solution of 1-hydroxy ethane-1,1-diphosphonic acid (hereinafter HEDPA), a 40 percent aqueous solution of hydroxyacetic acid, a 25 percent aqueous solution of polyacrylic acid, and a 50 percent solution of sodium hydroxide.

The liquid composition was prepared by first mixing 2140 grams of the sodium hydroxide solution with 1000 grams of deionized water. A liquid composition of the organics was prepared by mixing 722 grams of the HEDPA, 1435 grams of the hydroxyacetic acid, and 665 grams of the polyacrylic acid. The sodium hydroxide solution was slowly added to the organic liquid composition. Addition of the composition to the cell was made through the brine sight glass.

The addition, in both pounds per square foot and equivalents per square centimeter per day, the cathode voltage, and the cell voltage, are shown in Table I.

TABLE I

| Day after first addition (days) | Addition: Pounds per sq. foot | Addition: Gram Equivalents of hydroxyacetic acid per sq. cm. per day | Cathode voltage (volts) | Cell voltage (volts) |
|---|---|---|---|---|
| 1 | 0.103 | | 1.28[1] | 3.62 |
| 2 | | | 1.30 | 3.66 |
| 3 | | | 1.31 | 3.67 |
| 4 | | | 1.32 | 3.68 |
| 5 | | | 1.32 | 3.68 |
| 6 | | | 1.32 | 3.69 |
| 7 | | | 1.33 | 3.68 |
| 8 | | | | 3.67 |
| 9 | | | 1.32 | 3.67 |
| 10 | | | 1.33 | 3.67 |
| 11 | | | | |
| 12 | | | | |
| 13 | | | 1.33 | 3.68 |
| 14 | | | | |
| 15 | | | | |
| 16 | | | | |
| 17 | | | | |
| 18 | | | | |
| 19 | | | | |
| 20 | | | | |
| 21 | | | | |
| 22 | | | | |
| 23 | 0.051 | 0.140 | 1.21[2] | 3.60[2] |
| 24 | | | 1.23 | 3.62 |
| 25 | | | 1.24 | 3.63 |
| 26 | | | 1.25 | 3.65 |
| 27 | | | 1.27 | 3.66 |
| 28 | | | 1.28 | 3.65 |
| 29 | | | 1.29 | 3.66 |
| 30 | | | 1.33 | 3.67 |
| 31 | | | | |
| 32 | | | | |
| 33 | 0.026 | 0.164 | 1.22[3] | 3.62[3] |
| 34 | | | 1.22 | 3.62 |
| 35 | | | 1.25 | 3.65 |
| 36 | | | 1.26 | 3.65 |
| 37 | | | 1.27 | 3.66 |
| 38 | | | 1.27 | 3.66 |
| 39 | | | 1.32 | 3.66 |
| 40 | | | 1.33 | 3.67 |

Footnotes:
[1]After Addition. Prior to addition the cathode voltage was 1.33 volts and the cell voltage was 3.80 volts.
[2]After Addition. Prior to addition the cathode voltage was 1.33 volts and the cell voltage was 3.68 volts.
[3]After Addition. Prior to addition the cathode voltage was 1.33 volts and the cell voltage was 3.66 volts.

It is to be understood that although the invention has been described with specific references and specific details of preferred embodiments thereof, it is not to be so limited since changes and alterations therein may be made which are within the full intended scope of this invention as defined in the appended claims.

I claim:

1. In a method of electrolyzing alkali metal chloride brine in a diaphragm cell having an anolyte chamber containing an anode and a catholyte chamber containing a steel cathode, which method comprises feeding the brine to the anolyte chamber, and imposing a voltage across the cell whereby to evolve chlorine at the anode and hydrogen at the cathode, the improvement comprising feeding an hydroxy carboxylic acid chosen from the group consisting of alpha hydroxy carboxylic acids and aromatic hydroxy carboxylic acids and water soluble salts thereof and a phosphorous containing organic compound chosen from the group consisting of organic phosphonates and water soluble salts thereof to the cell.

2. The method of claim 1 comprising feeding a surfactant to the cell.

3. The method of claim 2 wherein the surfactant is a polymeric material having pendant acid groups.

4. The method of claim 3 wherein the pendant acid groups are carboxylic acid groups.

5. The method of claim 4 wherein the surfactant is polyacrylic acid.

6. The method of claim 1 wherein the feed rate of the hydroxy carboxylic acid is at least about 0.1 gram equivalent of hydroxy carboxylic acid per square meter of cathode area per day.

7. The method of claim 6 wherein the concentration of hydroxy carboxylic acid is at least 0.005 gram equivalent of hydroxy carboxylic acid per kilogram of catholyte liquor per feeding.

8. The method of claim 6 wherein the feed of the liquid composition is substantially continuous.

9. The method of claim 6 wherein the feed of the liquid composition is at substantially discrete intervals.

10. The method of claim 1 wherein the phosphorous containing organic compound is phosphonate having the $-P(O)(OM)_2$ group where M is chosen from the group consisting of hydrogen, sodium, potassium, and ammonium.

11. The method of claim 10 wherein the phosphorous containing compound is chosen from the group consisting of 1-hydroxy ethane-1,1-diphosphonic acid, nitrilo trismethylene triphosphonic acid, ethylene bis (nitrilo dimethylene) tetraphosphonic acid, and diethylene triamine penta (methylene phosphonic acid) and the salts thereof.

12. The method of claim 1 wherein the hydroxy carboxylic acid is chosen from the group consisting of hydroxy acetic acid, alpha hydroxy propionic acid, alpha hydroxy butyric acid, alpha-hydroxy-alpha-methyl-n-butyric acid, 2-hydroxy isobutyric acid, lactic acid, glyceric acid, citric acid, hydroxy benzoic acid, hydroxy cinnamic acid, hydroxy naphthoic acid, and mandelic acid.

13. The method of claim 12 wherein the hydroxy carboxylic acid is hydroxy acetic acid.

14. The method of claim 1 comprising feeding the hydroxy carboxylic acid to the anolyte chamber of the cell and imposing a hydrostatic head on the anolyte liquor whereby the anolyte liquor, containing the hydroxy carboxylic acid, passes through the diaphragm to the catholyte chamber of the cell.

15. The method of claim 1 comprising feeding the hydroxy carboxylic acid to the cell and maintaining the cathode hydrogen overvoltage below about 0.3 volt at a current density of 200 amperes per square foot of cathode area.

* * * * *